United States Patent [19]

Uebel

[11] 4,184,787

[45] Jan. 22, 1980

[54] VIBRATION DEVICE FOR GROUND COMPACTING

[75] Inventor: Phillip Uebel, Unterschleissheim, Fed. Rep. of Germany

[73] Assignee: Robert Bosch GmbH, Stuttgart, Fed. Rep. of Germany

[21] Appl. No.: 877,351

[22] Filed: Feb. 13, 1978

[30] Foreign Application Priority Data

Feb. 17, 1977 [DE] Fed. Rep. of Germany ..... 2706667

[51] Int. Cl.[2] ..... E01C 19/38

[52] U.S. Cl. ..... 404/117; 74/87

[58] Field of Search ..... 404/117, 113, 114, 133; 74/87, 61

[56] References Cited

U.S. PATENT DOCUMENTS

| | | | |
|---|---|---|---|
| 347,480 | 8/1886 | Feldmann | 74/87 X |
| 2,856,828 | 10/1958 | Brown | 404/113 |
| 2,868,094 | 1/1959 | Andersson | 404/117 |
| 2,894,435 | 7/1959 | Brown | 404/113 |
| 3,036,471 | 5/1962 | Peterson | 74/87 |
| 3,255,682 | 6/1966 | Hedstrom | 404/117 |
| 3,400,913 | 9/1968 | Matson | 74/87 X |
| 3,948,329 | 4/1976 | Cummings | 74/87 X |

*Primary Examiner*—Nile C. Byers, Jr.
*Attorney, Agent, or Firm*—Michael J. Striker

[57] ABSTRACT

A vibratory compactor includes a plate which is adapted to contact a substrate to be compacted, and a vibratory member which is mounted atop the plate for vibrating the same. The member includes imbalance elements mounted for rotation about an axis which is substantially parallel to the general plane of the plate. The imbalance elements are mounted for movement to and from a position which they assume once during each revolution. The compactor is further provided with a driving member for driving the imbalance elements in rotation.

19 Claims, 6 Drawing Figures

VIBRATION DEVICE FOR GROUND COMPACTING

BACKGROUND OF THE INVENTION

The invention relates to a vibratory device for compacting a substrate. Such a vibrarory device is usually used with a compacting plate which is installed on the substrate to be compacted. Such a vibrarory device includes balancing weights which rotate about an axis.

Such vibrarory devices are known as stampers, compacting plates, vibratory rollers, etc. and they are used to compact soil, concrete, tar, sand, etc.

The balancing weights when in rotation produce vibrations acting in all directions. The vibrations, especially those which are directed away from the ground to be compacted, negatively affect the working conditions of an operator of such a device. Besides, the uncontrolled vibrations negatively influence the driving mechanisms and other sensitive parts of the vibratory compactor.

SUMMARY OF THE INVENTION

It is an object of the present invention to provide a vibratory compactor of a simple construction which, when in operation, does not negatively affect the operator and only slightly affects the driving mechanisms and other sensitive parts of the vibratory compactor.

In pursuance of these objects and others which will become apparent hereafter, one feature of the present invention resides in providing a plate adapted to contact a substrate to be compacted; vibratory means mounted atop said plate for vibrating the same. The vibratory means include imbalance means mounted for rotation along a predetermined trajectory about an axis substantially parallel to the general plane of said plate. At least a portion of said trajectory has varying cross-section so that during at least a portion of each revolution the center of gravity of said imbalance means progressively moves between a first position in which it coincides with said axis and a second position in which there is a maximum distance between said center of gravity and said axis, and thereafter from said second position back to said first position. There are also provided drive means for driving said imbalance means in rotation.

In a preferred embodiment of the invention the imbalance means include at least a pair of bodies which are offset relative to ach other by an angle of 180° in the direction of rotation. The bodies are so selected with respect to their masses and spacings from the rotation axis that product of the mass of one body and the spacing of this body from the axis is at least during approximately half a revolution of the imbalance means is greater, and at no time period of the revolution smaller than the corresponding product of the other body. During this approximately half revolution the first body is situated on the side remote from the substrate side of the plane which passes through the rotation axis. The plane is either parallel to or inclined at an acute angle relative to the substrate.

During rotation of the imbalance means a force is generated which is primarily directed towards the substrate. This force may be used for compacting the substrate. At the start and the end of each revolution there are generated small forces which are directed upwardly. These forces, however, are compensated for substantially by the weight of the vibratory compactor. Therefore these small forces may be disregarded. The value of the compacting force depends on the trajectory of rotation of the imbalance means, on the distance between the center of gravity of the bodies and the axis of rotation and on the rotation speed.

In another embodiment of the invention one body is unchangeably spaced from the rotation axis, while the other body is spaced from the rotation axis by a varying distance. The distance between the center of gravity of the imbalance means changes during each revolution and is located in the plane which is parallel to the substrate. This distance changes during the first half phase of each revolution from zero to a maximum. During the second half phase of each revolution this distance is constantly on the zero value. Thus, during the second half phase of each revolution the center of gravity is located on the rotation axis. Such a feature is advantageous with respect to the vibratory compactor which has to have low vibrating frequency.

Still another embodiment of the present invention teaches bodies which have equal masses and are guided so that the distance between the center of gravity and the rotation axis during the period of each revolution when the bodies run along a first portion of the circular path located above the above-mentioned plane, that is on the side remote from the substrate is at least equal to that measured when the bodies run along a second portion of the circular path, which second portion is located between the plane and the substrate. At least during a section of said first portion this distance is larger than that measured during the second portion of the circular path.

Thus, the distance of the center of gravity from the above-mentioned plane which passes through the rotation axis and is substantially parallel to the substrate changes during each revolution progressively from zero to a maximum and thereafter from the maximum to zero. Such an arrangement renders it possible to obtain high vibrating frequencies.

At least one of the bodies runs along a guided trajectory around the rotation axis. The distance of this guided trajectory from the rotation axis is constant in the region between the substrate and the above-mentioned plane. This distance increases above this plane in direction of rotation, that is the distance is increased to a certain maximum and then decreases to the constant value. The plane may be arranged at an acute angle to the substrate, that is relative to its zero position namely parallel to the substrate. The plane may be rotated either in or opposite relative to the direction of rotation. Changes of the position of the plane relative to the substrate results in changes in direction of the vibration forces and therefore in changes of the components of those forces. The force components which do not affect the compacting work are used for moving the vibratory compactor back and forth independently of the moves of the operator. Thus, the compacting force may be varied by changing the angular position of the plane respective to the substrate. Simultaneously, by changing the angular position of the plane one can change the horizontal component of the compacting force, to thereby move the vibratory compactor relative to the substrate.

The above-mentioned second portion of the circular path, that is the portion between the substrate and the plane, has a semi-circular cross-section and the first portion, that is the portion located above the plane, has semi-ellipsoidal cross-section which merges into semi-circular portion. The ellipsoidal portion has the shortest half-axis equal to the constant radius of the semi-circular portion. Thus, the compacting force arrives to its maximum value when the plane is parallel to the substrate. In this case the force is directed normally to the substrate. A preferably inclination of the plane from its parallel position to the substrate is within the range of ±45°.

The guiding path is arranged on an inner circumference of a casing which is coaxial with the rotation axis. The casing is stationary. However, the casing may be turnable, particularly manually, about the rotation axis. Thus, the plane which passes through the rotation axis and which separates two differently configurated portions of the circular guiding path may be arranged substantially parallel to the substrate or at any selected acute angle relative to the substrate. The corresponding inclination of the casing may be performed by the operator, by means of a handling grip arranged on the casing.

One of the bodies may be mounted in a cage which is rotatable about the rotation axis so as to be radially shiftable relative to the rotation axis . The other body may be fixedly connected to the cage. The other body is preferably integrally connected to the cage. Such a construction of the imbalance means is particularly simple.

In another embodiment, the rotatable cage is provided with two bodies for rotation therewith, which bodies are both free to radially shift within said cage.

The cage may be formed as one-piece member, or may consist of several parts which are arranged axially adjacent one another. In this case each of the separate parts is provided with a pair of bodies which are offset relative to each other by 180° in the direction of rotation. Such an arrangement is advantageous when the masses of the bodies and height of the cage are to be kept small, or where the compacting force shall be substantially increased without increasing the masses of the bodies or the height of the cage.

The radially shiftable bodies may be spheres, balls, cylindrical bodies, rollers, cylinders, discs, etc.

The cage is coaxially arranged in a hollow cylinder which serves as a compacting plate. The hollow cylinder is constantly in contact with the substrate, so that the small transversely oriented vibrations are damped by a counterforce from the substrate to be compacted. Thus, the operator is relieved substantially from all vibrations, which factor makes it possible for the operator to easily operate the vibratory compactor. The vibratory compactor is particularly useful for compacting soil, concrete, tar, asphalt, etc.

The drive means for driving the imbalance means preferably include an internal combustion engine or an electromotor. In this case the electromotor is arranged on an arm which is firmly fixed on the casing. The drive motion may be transmitted from the motor to the cage via a belt or a chain transmission. The motor may be flanged to the casing, for instance, coaxially with the rotation axis.

The cage is fixed on a driven shaft which is fixed coaxially on the casing for rotation therewith. The hollow cylinder rotates on bearings about the casing and extends in the space between the casing and the motor arm. The handle is attached to the motor arm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
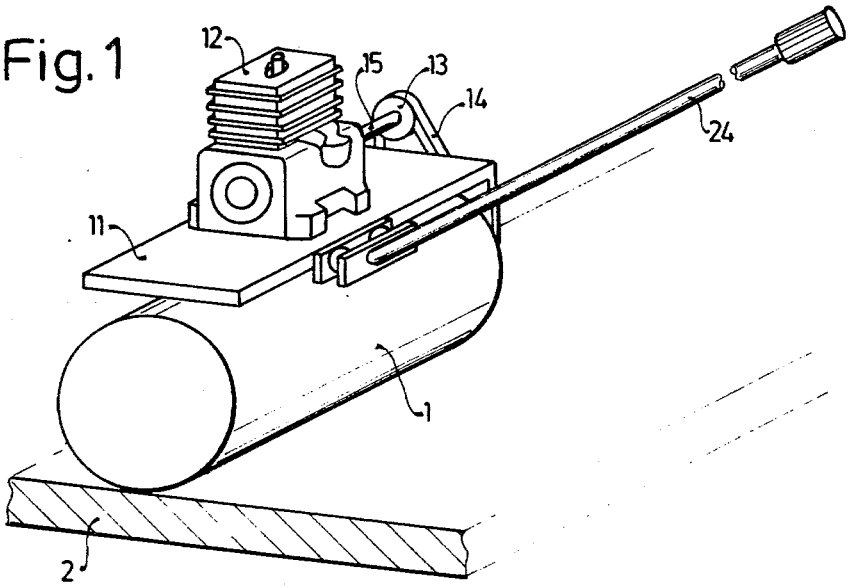
FIG. 1 is a perspective view of a vibratory compactor in accordance with the present invention.

Referring now to the drawings, and first to the FIG. 1 thereof, it may be seen that the reference numeral 1 designates a cylinder for transmitting the compacting forces onto the substrate to be compacted. A casing 3 is arranged within the interior of the cylinder 1 (see FIGS. 2 and 3). A shaft 14 is placed coaxially with the cylinder 1 and the casing 3. A cage 5 is fixedly mounted on the shaft 4 and located within the casing 3. The cage 5 receives a number of balls 6. The balls 6 rotate with the cage 5. The shaft 4 is mounted on inner bearings 7 and 8 within the casing 3 for rotation about an axis 23, which is simultaneously the central axis of the casing 3. The hollow cylinder 1 pivots relative to the casing 3 on coaxially mounted bearings 9 and 10. An arm 11 for carrying a motor 12 is flanged to the end face of the casing 3 so that the cylinder 1 pivots in the space between the arm 11 and the casing 3. The arm 11 is fixed on the shaft 4 which is provided at the corresponding end portion thereof with a driving wheel 13 which is driven via a belt 14 by a motor shaft 15 (see FIG. 1).

Figure 3:
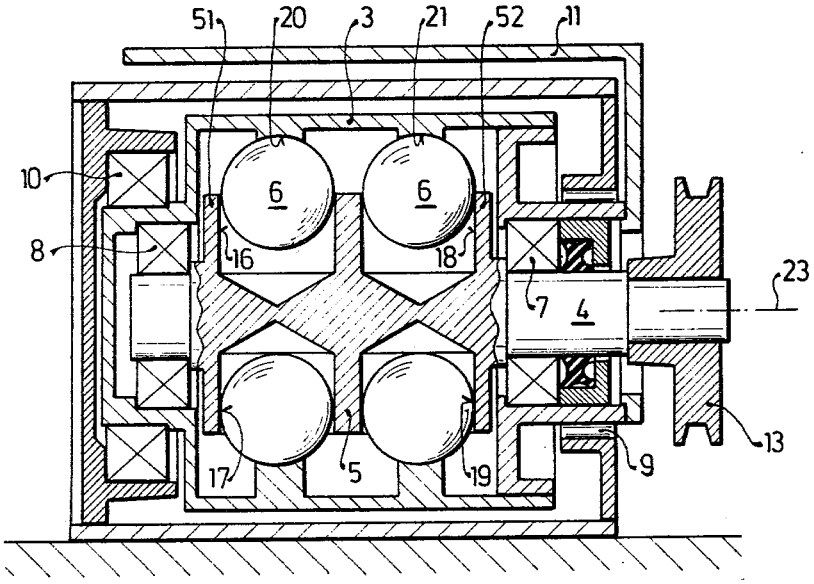
FIG. 3 is a sectional view taken along the line III—III in FIG. 2.

The cage 5 includes two axially and successively arranged identical parts 51 and 52 (see FIG. 3). Each of these parts has a pair of radial bores 16, 17 and 18, 19, respectively, which are circumferentially offset relative to each other by an angle of 180°.

The balls 6 are installed in the corresponding bores so that the balls are free to move radially along the respective bores. For this purpose the diameter of the bores slightly exceeds that of the balls, so that the balls are shiftable within the corresponding bores radially relative the rotation axis 23.

The inner surface of the casing is provided adjacent to each of the parts 51 and 52 with guides 20 and 21, respectively. The balls 6, when the cage 3 rotates centrifugally the corresponding guides 20 or 21. (See FIG. 3). The guides 20 and 21 are identical, and as shaped each of them has two differently configurated portions spaced from each other by 180° in direction of rotation of the cage 3 (see FIG. 2).

Figure 2:
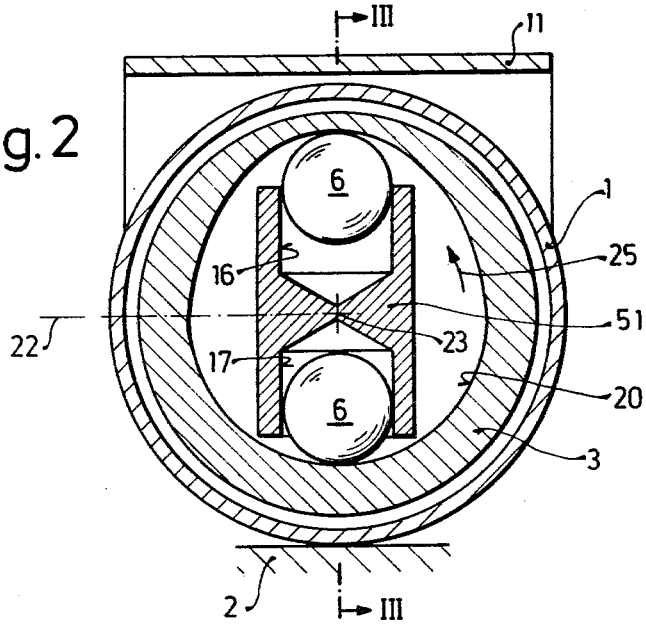
FIG. 2 is a cross sectional view of the vibratory compactor shown in FIG. 1.

One portion is located between the substrate 2 and plane 22 which passes through the axis 23 and is normally parallel to the substrate. This portion has a circular (i.e. constant) cross-section, that is each individual point of this portion of each of the guides 20 and 21 is equally spaced from the rotation axis 23. Each of the guides 20 and 21 includes another portion of noncircular (i.e. varying) cross-section. In FIG. 2 this portion is shown above the plane 22. This section has an ellipsoidal cross-section (see FIG. 2), whose shorter axis corresponds to the diameter of the circular portion. In the direction shown by an arrow 25, the distance of the guides 20 and 21 from the rotation axis increases from the distance equal to circular radius progressively to the maximum at the end of a section of 90° from the end of the circular portion. From this maximum on the distance progressively decreases until it reaches the circular radius volume. On the level of the plane 22, both these portions join each other.

A handle 24 is mounted on the motor arm 11. The handle 24 is operative to facilitate the manipulation of the vibratory compactor by the operator. In a normal position of the vibratory compactor, both the motor arm 11 and the plane 22 are in horizontal position, that is parallel to the substrate 2. By lifting or lowering of the handle 24 one can vary angular position of the plane 22 relative to the substrate 2, to thereby achieve forward and rearward movement of the compactor along the substrate to be compacted and variation of the compacting force applied to the substrate.

The motor shaft 15 rotates via the belt 14 the shaft 4 and the cage 5. Rotation of the cage 5 causes rotation of the balls 6, which are centrifugally shifted at least partially from the corresponding bores 16, 17, 18 and 19 until they abut the corresponding guides 20 and 21.

Figure 4:
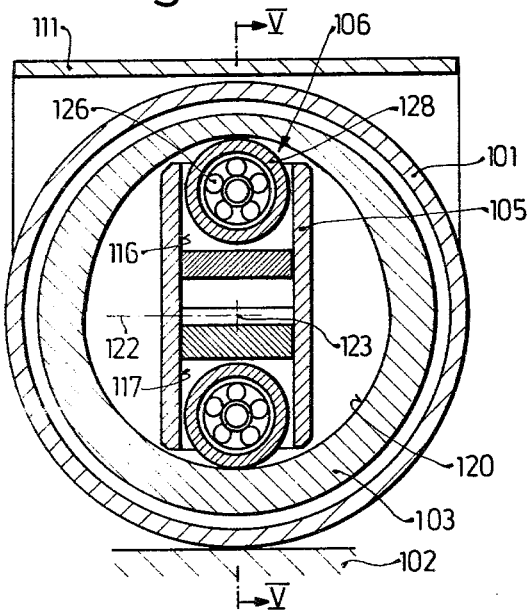
FIG. 4 is a cross-sectional view of another embodiment of the vibratory compactor shown in FIG. 1.
Figure 5:
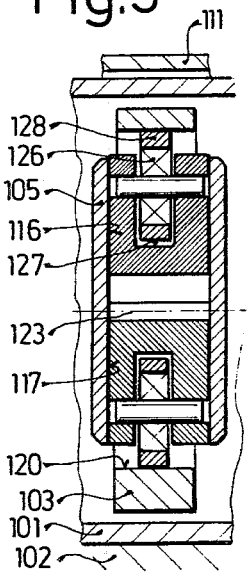
FIG. 5 is a sectional view taken along the line V—V in FIG. 4.

FIGS. 4 and 5 show another embodiment of the vibratory compactor partially similar to that shown in FIGS. 2 and 3. For the sake of clearness the same parts are designated by the same reference numerals as those used in FIGS. 2 and 3, however, increased by 100.

The casing 103 and the cage 105 are mounted within the hollow cylinder 101. The motor arm 111 is located on the casing 103. Two cylindrical bodies 106 are radially movably received in the radial bores of the cage 105. The cylindrical bodies 106 have cylindrical rings 128 with bearings 126. The cylindrical body 106 remains centrifugally movable relative to the axis of rotation 123. The axes of cylindrical rings 128 are parallel to the rotation axis 123. During rotation of the cage 105, these cylindrical rings 128 are guided by the guide 120 of the casing 103. The sliding pieces 127 are radially shiftable within the radially arranged bores 116 and 117. The cage 105 (similarly to the embodiment shown in FIG. 3) may be subdivided into several parts, wherein each of these parts includes a pair of cylindrical bodies 106 which are mutually circumferentially offset from each other by an angle of 180° (see FIG. 5).

The embodiment shown in FIGS. 4 and 5 is similar to that disclosed hereabove with respect to the embodiment shown in FIGS. 2 and 3.

Figure 6:
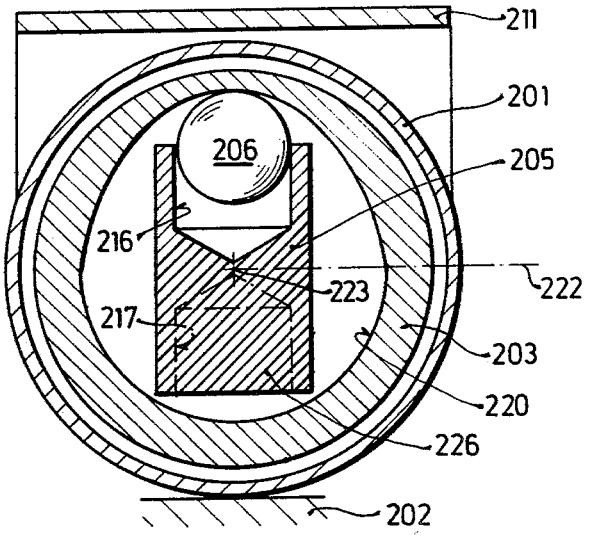
FIG. 6 is a cross-sectional view of a third embodiment of the vibratory compactor shown in FIG. 1.

FIG. 6 shows a third embodiment of the vibratory compactor, which embodiment is quite similar to those shown in FIGS. 2, 3, 4 and 5. Therefore, the parts of this embodiment which are similar to those shown in FIGS. 2, 3, 4 and 5 are designated by the same reference numerals, however, increased by 200.

The hollow cylinder 201 receives the casing 203 which is provided on its inner circumference with the guide 220. The cage 205 located in the interior of the hollow cylinder 201 and the arm 211 fixed on the casing 203 are identical to the corresponding members shown in FIGS. 2 and 3 so that the entire description with regard to these elements as to the FIGS. 2 and 3 may be herewith applicable to the embodiment in FIG. 6. The cage 205 is located inside the casing 203, and includes two radial bores which are offset relative to each other by 180°, namely bores 216 and 217. The bore 216 receives the ball 206, whereas the bore 217 receives a member 226 which is stationary within the bore 217. The member 226 may be integrally connected to the cage 205. The mass of the member 226 is so selected, that the product of the mass of the member 226 and the distance of the center of gravity of this member 226 from the axis 223 is equal to that of the mass of the ball 206 and the distance of the center of gravity of the ball 206 from the axis 123 when the cage 205 rotates by 180°.

Thus, during one half of each revolution a resulting force is directed towards the substrate, to thereby compact the same. Frequency of vibration in this case is twice as small as that in the embodiment shown in FIGS. 2, 3, 4 and 5. Otherwise, construction of the embodiment shown in FIG. 6 is identical to that shown in FIG. 2. In particular, the plane 222 can be angularly displaced relative to the substrate, to thereby change the force applied thereto or to move the vibratory compactor along the substrate to be compacted.

It is to be understood that the present invention is not limited by the embodiments shown in the drawings. For example, the cylinder may be replaced by a flat compacting plate in the form of sledge which is set forth to horizontally transform motion of the vibratory compactor on to the substrate. Also, the guides do not have to be configured as in FIGS. 2, 4 and 6. Moreover, one portion of the guide does not necessarily have to be ellipsoidal. It may have any other varying cross-sectional form. The only requirement is that the spacing of the center of gravity of the balance weight increase from zero to maximum and vice versa. Also, anywhere along this portion of varying cross-section, the distance from the center of gravity to the axis of rotation should not be smaller than that anywhere along the portion with constant cross-section.

I claim:

1. In a vibratory compactor, a combination comprising a plate adapted to contact a substrate to be compacted; vibratory means mounted to said plate for vibrating the same and including imbalance means mounted for rotation in a predetermined path along guide means and about an axis substantially parallel to the general plane of said plate, at least a portion of said guide means having varying cross-section so that during at least a portion of each revolution the center of gravity of said imbalance means progressively moves between a first position in which it coincides with said axis and a second position in which there is a maximum distance between said center of gravity and said axis, and thereafter from said second position back to said first position; and drive means operatively related to said imbalance means for driving said imbalance means in rotation.

2. A combination as defined in claim 1, wherein said portion is substantially equal to half of each revolution; said imbalance means including at least a pair of bodies circumferentially spaced from each other.

3. A combination as defined in claim 2, wherein said bodies are spaced from each other by 180°.

4. A combination as defined in claim 3, wherein said bodies each have a predetermined weight factor and are each so spaced from said axis by a distance factor that the product of the two factors relative to one of said bodies exceeds the product of the two factors relative to the other body during at least said portion of each revolution, said product relative to said one body being not smaller than said product relative to said other body throughout the complete revolution of the imbalance means.

5. A combination as defined in claim 4, wherein said one body at least during said portion of each revolution is located above a plane defined by said axis, said plane being parallel to the substrate to be compacted.

6. A combination as defined in claim 5, wherein said one body at least during said portion of each revolution is located above a plane defined by said axis, inclined relative to the substrate to be compacted.

7. A combination as defined in claim 6, wherein said other body is fixedly mounted relative to said axis, so that said other body is capable only of rotation about said axis.

8. A combination as defined in claim 4, wherein said one body at least during said portion of each revolution is located above a plane defined by said axis, inclined relative to the substrate to be compacted, said one body being movable at least during said portion of each rotation relative to said axis to thereby vary the distance from the center of gravity of said imbalance means to said axis at least during said portion of each revolution.

9. A combination as defined in claim 4, wherein said one body at least during said portion of each revolution is located above a plane defined by said axis, inclined relative to the substrate to be compacted, said bodies having the same predetermined weight and being so arranged relative to said axis that at least during said portion of each revolution the center of gravity of said imbalance means is spaced from said axis by a distance exceeding the distance by which it is spaced from said axis during the rest portion of each revolution.

10. A combination as defined in claim 9, wherein said guide means include a first portion having a constant cross-section and a second portion having a varying cross-section.

11. A combination as defined in claim 10, wherein said first portion has a circular cross-section and is located between said plane and the substrate to be compacted; said second portion having an ellipsoidal cross-section and being located above said plane.

12. A combination as defined in claim 11, wherein said guide means further include a casing coaxial with said axis and having an inner circumference constituted by said first and second portions; said first portion forming a half-circle of a circular radius, and said second portion forming a half axis corresponding to said circular radius so that said ellipsoidal portion merges into said circular portion.

13. A combination as defined in claim 12; and further comprising means for pivoting said casing about said axis, said pivoting means including a handle operatively connected to said casing for pivoting the latter.

14. A combination as defined in claim 12, wherein said imbalance means further include a support operative for supporting said bodies and mounted on said axis for rotation thereabout, said support being provided with at least two bores circumferentially spaced from each other and operative for receiving said bodies in the respective bores to rotate therewith, at least one of said bodies being movable radially relative to said axis within the respective bore and relative to said support.

15. A combination as defined in claim 14, wherein both bodies are movable radially relative to said axis within the corresponding bores relative to said support; said bores being circumferentially spaced from each other by an angle of 180°.

16. A combination as defined in claim 14, wherein said support comprises a member of separate sections, each of said sections being provided with at least two boxes circumferentially spaced from each other, said sections being located axially adjacent to one another.

17. A combination as defined in claim 14, wherein said drive means include a motor operatively connected to said support, said casing being provided with a stationary base operative for supporting said motor, said base being fixedly connected to said handle.

18. A combination as defined in claim 14, and further comprising a hollow housing operative for receiving in the interior thereof said casing, said housing being coaxial with said axis.

19. A combination as defined in claim 18, wherein said drive means further include a driven shaft fixedly connected to said support for rotation therewith and mounted on a set of bearings fixedly located on said housing.

* * * * *